US007431536B2

(12) United States Patent
Benda

(10) Patent No.: US 7,431,536 B2
(45) Date of Patent: Oct. 7, 2008

(54) METHOD OF MAKING A FLAT FOUNDATION FOR A FLOOR WITHOUT SUBSTANTIAL EXCAVATION AND FOUNDATION MADE BY SAID METHOD

(76) Inventor: Jiri Benda, Pozëmicke 45/50, 748 01 Hlucin-Bobrovoiky, okres Opava (CZ)

( * ) Notice: Subject to any disclaimer, the term of this patent is extended or adjusted under 35 U.S.C. 154(b) by 197 days.

(21) Appl. No.: 10/552,211

(22) PCT Filed: Sep. 18, 2003

(86) PCT No.: PCT/CZ03/00051

§ 371 (c)(1),
(2), (4) Date: Oct. 6, 2005

(87) PCT Pub. No.: WO2004/090240

PCT Pub. Date: Oct. 21, 2004

(65) Prior Publication Data

US 2006/0213146 A1 Sep. 28, 2006

(30) Foreign Application Priority Data

Apr. 10, 2003 (CZ) ..... PV 2003-1002

(51) Int. Cl.
*E04B 1/16* (2006.01)

(52) U.S. Cl. ..... 405/229; 52/169.1; 52/169.2

(58) Field of Classification Search ..... 405/229; 52/169.1, 169.2, 169.3
See application file for complete search history.

(56) References Cited

U.S. PATENT DOCUMENTS

| | | | | | |
|---|---|---|---|---|---|
| 4,778,309 | A * | 10/1988 | Bach et al. | ..... | 405/284 |
| 4,965,097 | A * | 10/1990 | Bach | ..... | 428/194 |
| 5,067,298 | A * | 11/1991 | Petersen | ..... | 52/742.14 |
| 5,085,539 | A * | 2/1992 | Massarsch | ..... | 405/229 |
| 6,296,924 | B1 * | 10/2001 | Bach | ..... | 428/137 |
| 6,484,473 | B1 * | 11/2002 | Hall | ..... | 52/741.1 |

* cited by examiner

*Primary Examiner*—Tara L. Mayo
(74) *Attorney, Agent, or Firm*—Nataro & Michalos P.C.

(57) ABSTRACT

Cellular foil (3) is unfolded between the surface of earth base course (1) and the first floor layer (5) during building the subsoil, which cellular foil (3) is poured over with fill (4) from loose material at least up to filling the compartments. A bedding (2) from loose material, optimally from sand, is created under the cellular foil (3). Geotextile (6) may be incorporated to the area under the cellular foil (3). Bedding (2) of lower grain size than that of the fill (4) is preferably used, wherein the fill (4) has optimal grain size of 8 to 63 mm. Compaction is done by at least eight travels of roller of 10 to 11 tons weight, also including vibrations when the height of fills is exceeding 25 cm above the cellular foil (3).

5 Claims, 4 Drawing Sheets

Figure 1:
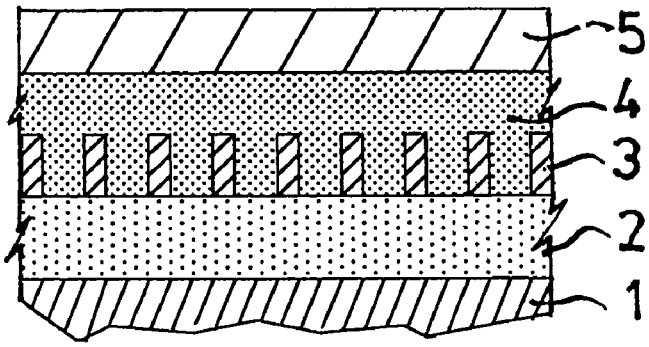

METHOD OF MAKING A FLAT FOUNDATION FOR A FLOOR WITHOUT SUBSTANTIAL EXCAVATION AND FOUNDATION MADE BY SAID METHOD

TECHNICAL FIELD

The technical solution relates to a new method of shallow foundation of floor, particularly for high load bearing floors of buildings such as large-area halls etc. New arrangement of floor subsoil is created using this method.

BACKGROUND ART

During foundation of industry floors, such system of making-up of subsoil and construction layers of earth plate should be selected, to ensure maximum fulfilment of the floor reliability criteria. Used methods of floor foundation include shallow foundation and deep foundation.

Currently known method of shallow foundation of floor includes creation of classical distributing gravel pad from psephite material such as crushed quarry aggregate, crushed ballast, gravel, gravel sand, and sand. Using this method, surface of earth base course is removed first, often in high volumes, and subsequently made-up grounds of loose materials are performed. Gravel pad created in this way is sometimes reinforced with the help of geotextile or chemical solidification. Subsoil created using these methods consists of pad of loose material, possibly intercalated with geotextile, and of the first floor layer placed on the pad. In case of using the method of chemical solidification, for instance lime stabilisation, chemically solidified layer is additionally contained as an underlayer located on the earth base course. For instance in the case of lime stabilisation, before made-up of gravel pad, solidified layer is created first by the process when the earth layer is mixed with lime, which, after binding water from terrain, will create solidified layer on the basis of calcium carbonate. The first floor layer is then placed directly on this chemically solidified layer or on gravel pad placed on the chemically solidified layer. Disadvantage of these methods include risk of non-uniform load-bearing capacity and uneven settlement of the whole redeveloped area and associated possible problems during cracking of the flooring assembly in the future. Consequences are manifested as local kneeling or heaving of the floor and cracking of the floor. Other disadvantages of the aforementioned methods include the need to remove material in considerable volumes, necessity to ensure landfills for mucked materials, transportation costs associated with supply of filling materials, and time demands. Other disadvantage when using chemical solidification is the risk of environmentally unfavourable action of chemical preparations, namely lime.

Known method of deep foundation is the method of consolidation with the help of pillars, usually filled with gravel. Using this method includes boring pits of various lengths and diameters into the earth base course, which are subsequently filled with gravel of various grading or with lime. Pillars created in this way are sometimes combined with gravel pad or geotextile. The first floor layer is then placed on the background created in this way. In this case, the subsoil consists of earth base course, pillars of various lengths and widths, optional gravel pad and/or possibly one or several layers of geotextile, and the first floor layer. Other known methods of deep foundation are the methods of solidification with the help of injection, such as Soil-mixing or compaction grouting. In such case, the subsoil consists at least of earth base course, a layer chemically solidified by injection, and the first floor layer. Disadvantages of existing methods of deep foundation are, beside its high demands on mechanization, time and financing, also and particularly the uncertainty of ensuring uniform load-bearing capacity of the floor and even settlement of the floor across the whole redeveloped area. The consequences are usually, just like in the case of aforementioned methods of floor shallow foundation, cracking of floors in buildings and local sinking or heaving of the floor.

So called cellular foil is known for consolidation of sole of terrains without buildings, such as roads, walkways, pavements, slopes, grass plots, playgrounds etc. Its arrangement is known for instance from patent specifications of U.S. Pat. No. 5,449,543, WO 97/16604 and of CZ PV 1286-98. This cellular foil is created from strips on the basis of plastics that are vertically positioned and interconnected by welding seams or other joints so that a web structure with vertical walls is created, which in a state stretched on a plane contains system of vertically open compartments.

DISCLOSURE OF INVENTION

The above mentioned disadvantages are eliminated to a considerable extent by the invention. Method of floor shallow foundation is solved, by which the floor subsoil for buildings, halls in particular, is built on modified earth base course, where the floor is shallow founded so that the first floor layer from concrete-based material is laid on modified background. The essence of the invention is that at least one layer of cellular foil in unfolded state is laid down onto the background before laying down the first floor layer, than this cellular foil is overfilled with fill from loose material reaching at least up to the foil height, thus filling the cavities in chambers of the cellular foil, the fill is then compacted and the first floor layer is laid down only now on this compacted fill.

Before laying down the cellular foil, the earth base course is preferably equipped with at least one pad from loose material on the basis of gravel and/or sand, which is then compacted, and thus bedding for cellular foil is created.

Generally, material of finer grading than fill is preferably used as bedding. Sand is the best material for bedding.

During building of floor subsoil, some layer built before placing of the first floor layer can be equipped with geotextile stretched in plane. Exceptionally, the geotextile can be placed in multiple layers.

Quarry stone having sharp edges and grading from dust particle size up to 63 mm, optimally of the grain size 8 to 63 mm, is preferably used as the fill.

The fill mentioned above is compacted, preferably by at least eight travels of roller with mass of 10 to 11 metric tons.

In the case when the fill is created to the height of at least 25 cm above the cellular foil, vibration of travelling roller can be preferably switched on.

New structural arrangement of the floor subsoil is created by the proposed invention. Floor subsoil made by the process according to the invention differs from the existing solutions particularly in that it contains a pad from cellular foil with compartments and from fill between the surface of earth base course and the first floor layer on the basis of concrete. Cellular foil is in a state unfolded to a plane and the fill consists of loose material such as gravel, sand and/or gravel sand filling compartments of this cellular foil and reaches at least from the lower edge of the cellular foil to at least upper edge of the cellular foil.

At least one layer of bedding of grain size finer than the grain size of the fill is located under the cellular foil and above the surface of the earth base course, preferably considering properties of terrain.

Floor subsoil according to the invention can contain at least one geotextile unfolded in a planar way, preferentially between the first floor layer and the surface of the earth base course. Generally, it is preferential, when the geotextile is located under the cellular foil, i.e. directly under the foil or in some layer under the cellular foil or on some layer located under the cellular foil.

The invention allows creation of subsoil with uniform load-bearing capacity and equal settlement of the subsoil. The subsoil and consequently also the floor are solid, are not sinking locally nor spinning in a plane, edges are not lifting, the floor is not cracking and the whole surface of the floor has the same load-bearing capacity. The invention is utilizable particularly for industrial floors, factory buildings and halls with high load bearing floor such as freezing plants, supermarkets, garages etc. It can replace the existing methods of floor foundation, both methods of shallow foundation and methods of deep foundation as well. It can be also combined with the methods mentioned above, as the case may be. It can eliminate the necessity to build pillars and/or remove large volumes of earth base course. The subsoil can be created quickly and without demanding modifications or substantial interference with background from earth base course.

REVIEW OF FIGURES ON DRAWINGS

The invention is illustrated using drawings, where

Figure 2:
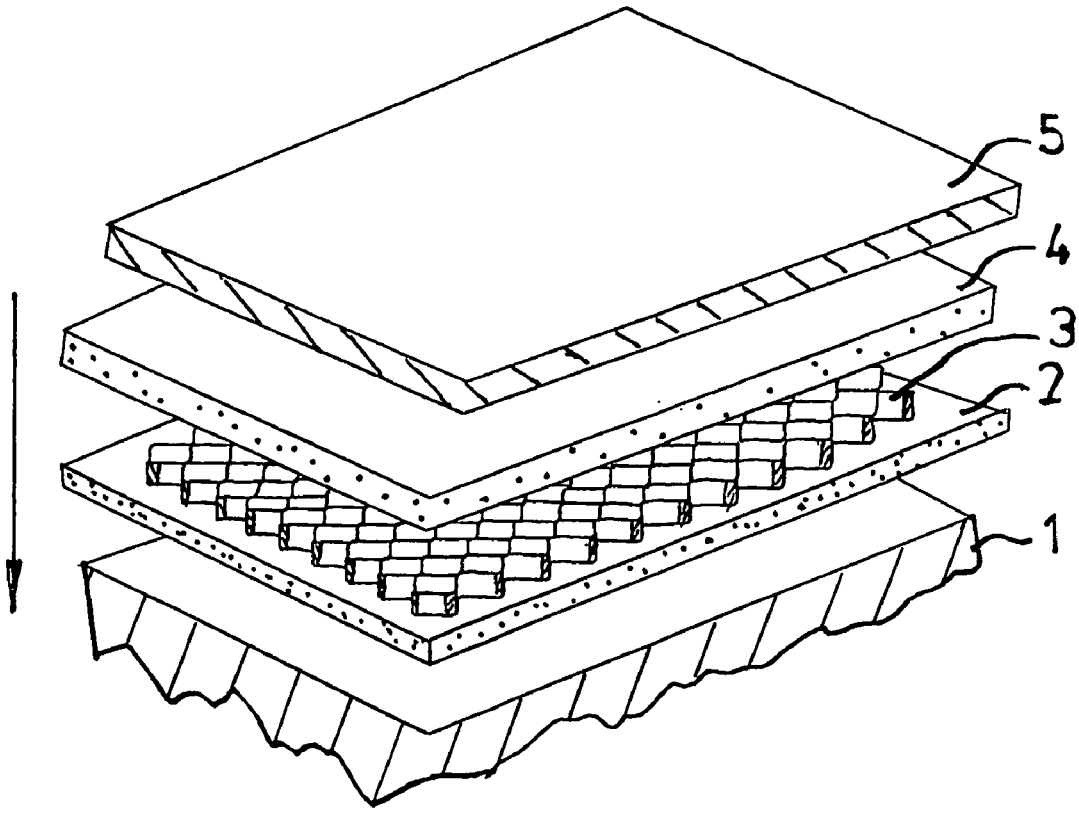
Figure 3:
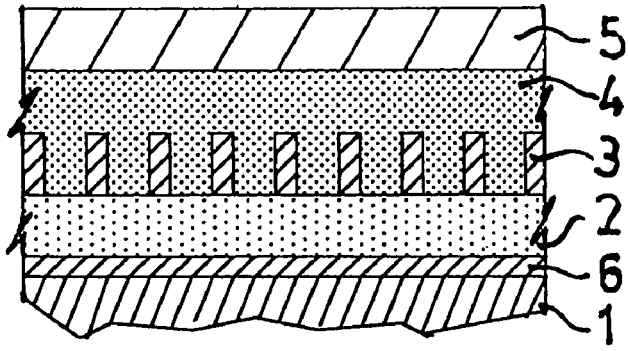
Figure 4:
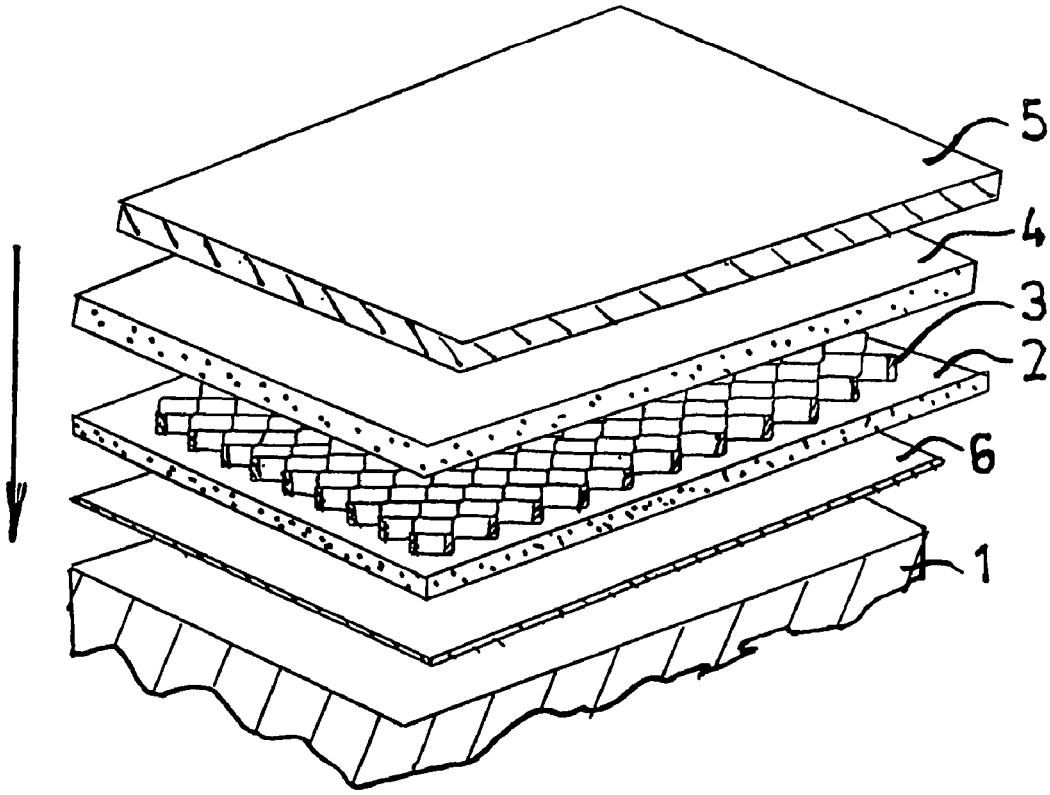
Figure 5:
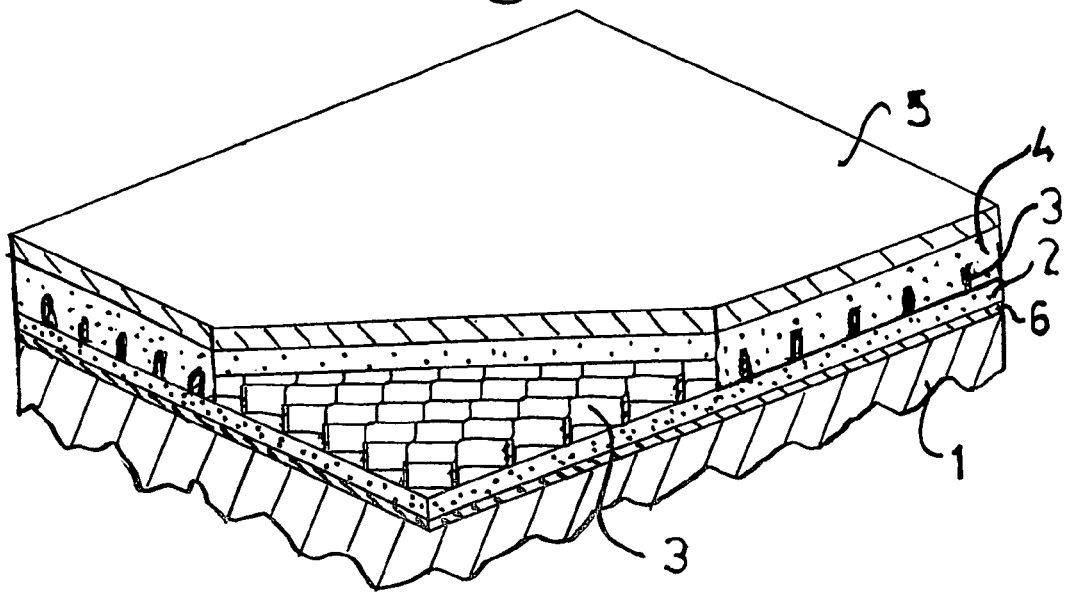
Figure 6:
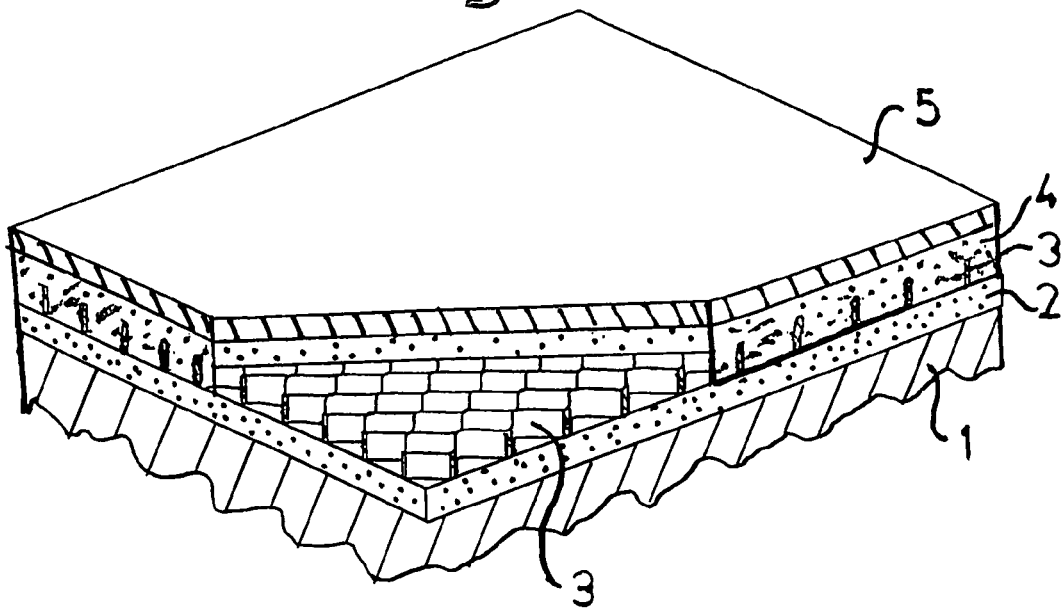
Figure 7:
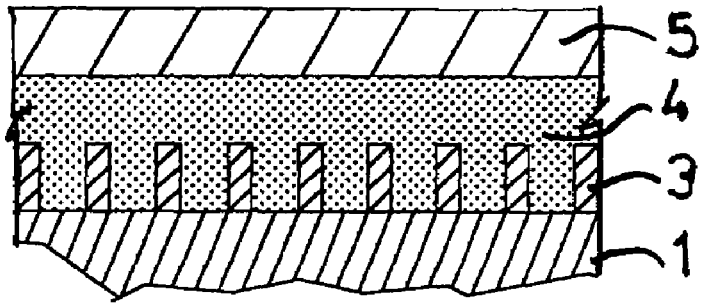
Figure 8:
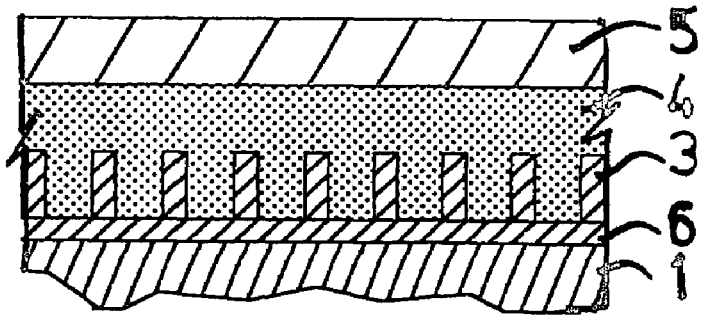
Figure 9:
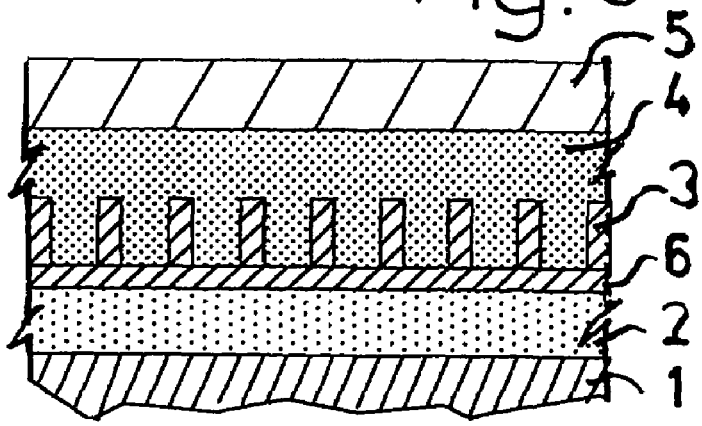

FIG. 1 shows representative subsoil according to the example 1, consisting of earth base course, bedding, cellular foil, fill and lower floor layer, FIG. 2 shows process of placing layers one to another according to the invention during making subsoil illustrated on the previous figure, FIG. 3 shows representative subsoil according to the example 2, consisting of earth base course, geotextile, bedding, cellular foil, fill and lower floor layer, FIG. 4 shows process of placing layers one to another according to the invention during making subsoil illustrated on the previous figure, FIG. 5 shows spatial arrangement of subsoil according to the example 2, FIG. 6 shows spatial arrangement of subsoil according to the example 1, FIGS. 7 to 9 show other variants of subsoil made by the procedure according to the invention.

EXAMPLES OF EMBODIMENT OF INVENTION

Example 1

Example of embodiment of the invention is the procedure of making the subsoil according to FIG. 2 and the subsoil for freezing store according to FIGS. 1 and 6 made by the procedure.

Drainage bedding 2 of broken quarry gravel aggregate with particle size of 32 to 63 mm has been brought to the surface of earth base course 1 evened to horizontal level. Bedding 2 has been levelled and compacted by 10 travels of roller weighing 10 metric tons with vibration. Compacted bedding 2 reached the height of 25 cm. Twenty cm high cellular foil 3 has been placed on the surface of this background and stretched in a plane so that it covers all the area designed for the building. Then, the fill 4 from quarry gravel aggregate with grain size of 32 to 63 mm has been gradually brought to the cellular foil 3. The aforesaid fill 4 has been dumped and a spread over the cellular foil 3 until it filled its compartments and reached the height of approx. 10 cm over the top edge of the cellular foil 3. The fill has been compacted with 12 travels of roller. Then, dumping of next 10 cm of fill 4 continued, this time from quarry gravel aggregate with grain size of 0 to 63 mm; Then, when the fill 4 reached 20 cm over the cellular foil, its compaction has been performed by twenty travels of roller weighing 10 metric tons, after which next 10 cm of the same material has been brought and compacted by twelve travels of the same roller using vibrations. Then, the overall height of the fill 4 reached 50 cm, and the cellular foil 3 has been incorporated in its lower part. The first floor layer 5 in the form of steel-fibre-reinforced concrete has been laid down onto such treated background. The floor, not shown on drawings, has been made on this subsoil, where next layers has been made in a common way, laying down heat insulation and reinforced concrete with tubular heating. The subsoil has been used for foundation of floor in a freezing plant.

The subsoil made by the aforesaid process contained, listed from the bottom to the top, earth base course 1, 25 cm high bedding 2, a pad on it from fill 4 and cellular foil 3, where the fill 4 was 50 cm high in total, and the aforesaid 20 cm high cellular foil 3 has been incorporated in its lower part, and the first floor layer 5 has been contained on this pad. Static load tests proved that the values of deformation modulus considerably exceeded stated requirements. The subsoil has been evaluated as a homogenous one with minimal differences in quality within the framework of the building. Values of the subsoil quality requirements has been considerably exceeded.

Example 2

Other, in the inventor's opinion the optimal example of embodiment of the invention is the process of making the subsoil according to the FIG. 4 and the subsoil for metal works hall according to FIGS. 3 and 5 made by the procedure.

Geotextile 6 of approximately 2 mm height has been placed on the surface of earth base course 1 evened to horizontal level by mucking the arable layer and plow pan. Drainage bedding 2 from sand with particle size of 0.63 to 2 mm has been brought on it. Bedding 2 has been levelled and compacted by 10 travels of roller weighing 11 metric tons. Compacted bedding 2 reached to the height of 10 cm. Fifteen cm high cellular foil 3 has been placed on the surface of this background and stretched in a plane so that it covers all the area designed for the building. Then, the fill 4 from quarry gravel aggregate with grain size of 8 to 63 mm has been gradually brought to the cellular foil 3. The aforesaid fill 4 has been dumped and a spread over the cellular foil 3 until it filled its compartments and reached the height of approx. 10 cm over the top plane of the cellular foil 3. The fill has been compacted with 12 travels of roller weighing 11 metric tons. Then, dumping and a spreading of the fill 4 continued. Later, when the fill 4 reached approximately 20 cm over the cellular foil 3, its compaction has been performed by eight travels of roller weighing 11 metric tons, after which next 10 cm of the same material has been brought. Then the surface has been compacted by ten travels of the same roller using vibrations. After compaction, the overall height of the fill 4 reached 45 cm, and the cellular foil 3 has been incorporated in its lower part. The first floor layer 5 in the form of concrete has been laid down onto background treated in this way. In this way, subsoil has been created on which the floor, not shown on drawings, has been made, where next layers has been made in a common way, laying down concrete, heat insulation and tile flooring, and a building of metal works has been raised.

This subsoil contained, listed from the bottom to the top, earth base course 1, approximately 2 mm high geotextile 6, 10 cm high bedding 2, a pad on it from cellular foil 3 and fill 4, where the fill 4 was 45 cm high in total, and the aforesaid 15 cm high cellular foil 3 has been incorporated in its lower part, and the first floor layer 5 has been situated on this pad.

Uniform load-bearing capacity of the floor and uniform settlement of the floor has been achieved.

Example 3

Embodiment of the invention has numerous variants, consistent in possible omitting of bedding 2 and omitting of geotextile 6, or incorporation of geotextile 6 in arbitrary height during creation of subsoil. The most frequent examples of these alternatives in the framework of the invention are illustrated on FIGS. 7 to 9.

FIG. 7 shows the subsoil created on earth base course 1, and containing only pad from cellular foil 3 and fill 4, and the first floor layer 5 placed on it.

FIG. FIG. 8 shows the subsoil created on earth base course 1, and containing geotextile 6, next the pad from cellular foil 3 and fill 4, and the first floor layer 5 placed on it.

FIG. 9 shows the subsoil created on earth base course 1, and containing bedding 2 on which resides geotextile 6, next the pad from cellular foil 3 and fill 4, and the first floor layer 5 placed on it. The abovementioned examples of embodiment only demonstrate options of embodiment of the invention, without limiting them, geotextile 6 can be for instance incorporated as intermediate layer inside the bedding 2 or the fill 4.

The invention claimed is:

1. A method of making a flat foundation for a floor of a structure without substantial excavation comprising the steps of:

excavating an earth base course (1), providing at least one drainage bedding layer (2) on the earth base course (1), compacting the bedding layer (2) using multiple travels of a roller on the bedding layer, spreading at least one layer of a plastic cellular foil (3) having vertically extending and upwardly open compartments on the drainage bedding layer (2), overfilling the compartments of said cellular foil (3) with fill (4) of Quarry stone of grain size 8 to 63 mm so that the fill (4) extends above the height of the cellular foil (3) by at least 25 cm, compacting the fill (4) over the cellular foil by at least eight travels of a roller of 10 to 11 metric tons weight and with vibration to form compacted fill (4), and laying a floor layer (5) of the structure on the compacted fill.

2. A method of making a flat foundation for a floor according to claim 1 wherein the material of the drainage bedding layer (2) is finer than the material of the fill (4).

3. A method of making a flat foundation for a floor according to claim 1, including the further step of providing at least one layer of geotextile (6) below the cellular foil (3).

4. A method of making a flat foundation for a floor according to claim 1 in which at least one further layer of fill (4) is placed over the compacted fill (4) and wherein the further layer of fill (4) is then compacted.

5. A method of making a flat foundation for a floor according to claim 1 in which two further layers of fill (4) are placed over the compacted fill (4) and wherein the two further layers of fill (4) are compacted.

* * * * *